US007434694B1

(12) United States Patent
Elvin

(10) Patent No.: US 7,434,694 B1
(45) Date of Patent: Oct. 14, 2008

(54) CYCLONE SEPARATOR WITH STACKED BAFFLES

(75) Inventor: Frank James Elvin, Bellaire, TX (US)

(73) Assignee: Fisher-Klosterman, Inc., Louisville, KY (US)

( * ) Notice: Subject to any disclaimer, the term of this patent is extended or adjusted under 35 U.S.C. 154(b) by 47 days.

(21) Appl. No.: 11/534,379

(22) Filed: Sep. 22, 2006

(51) Int. Cl.
*B04C 5/08* (2006.01)

(52) U.S. Cl. ..... 209/139.1; 209/711; 209/715

(58) Field of Classification Search ..... 209/711, 209/715, 720, 721, 151, 152, 139.1
See application file for complete search history.

(56) References Cited

U.S. PATENT DOCUMENTS 1,923,200 A * 8/1933 Hedberg ..... 209/150
1,960,887 A 5/1934 Alexander
1,985,947 A 1/1935 O'Mara
2,585,440 A * 2/1952 Collins ..... 96/237
2,681,124 A 1/1954 Van Der Kolk
2,672,215 A 3/1954 Schmid
3,550,356 A * 12/1970 Abboud ..... 96/316
3,618,299 A * 11/1971 Vincent ..... 96/304
3,989,488 A * 11/1976 Wisting ..... 96/237
4,221,655 A 9/1980 Nakayama et al.
4,721,603 A 1/1988 Krug et al.
5,042,998 A 8/1991 Beusen
5,171,423 A 12/1992 Kruse
6,957,740 B2 10/2005 Hoffmann

* cited by examiner

*Primary Examiner*—Joseph C Rodriguez
(74) *Attorney, Agent, or Firm*—Camoriano and Associates; Theresa Fritz Camoriano

(57) ABSTRACT

A cyclone separator has at least one baffle spaced inwardly from the cyclone separator housing to serve as a false wall which allows particles that separate from the gas stream to fall down between the baffle and the housing without being re-entrained into the gas stream.

7 Claims, 6 Drawing Sheets

CYCLONE SEPARATOR WITH STACKED BAFFLES

BACKGROUND

The present invention relates to cyclone separators, which are used to separate solid particles from a gas stream. One of the problems with cyclone separators is the re-entrainment of solid particles into the gas stream after they have been separated out from the gas stream.

SUMMARY

The present invention relates to a cyclone separator which uses stacked baffles lining the inside of the cyclone to create a "false" wall which protects the separated particles from re-entrainment into the gas stream. Several shapes of baffles can be used. There also may be a partial seal at the bottom of the cyclone to prevent the vortex from entering the dip leg and possibly causing re-entrainment of the particles.

DESCRIPTION

Figure 1:
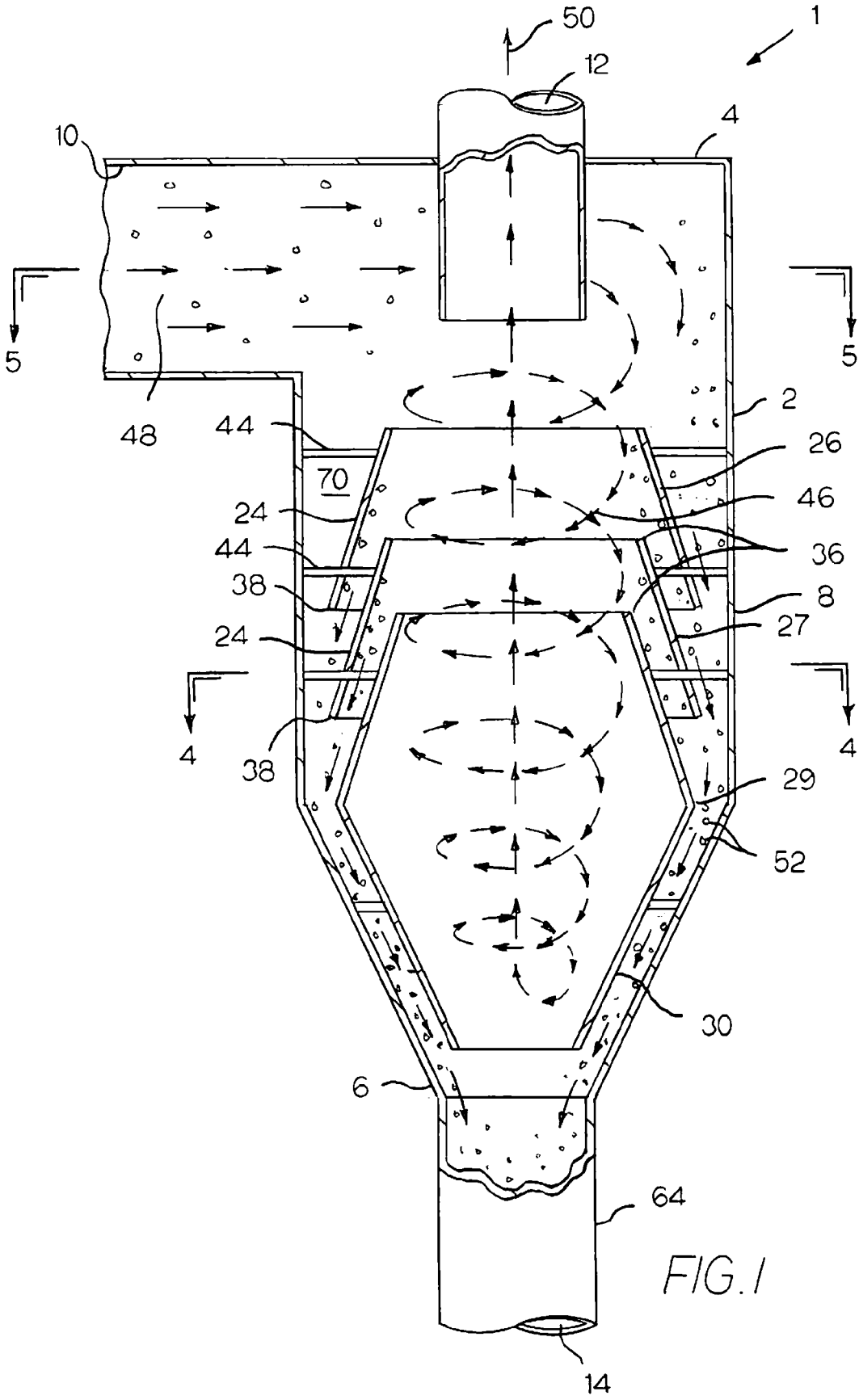
FIG. 1 shows a broken-away front view partially in section of a cyclone separator made in accordance with the present invention.
Figure 4:
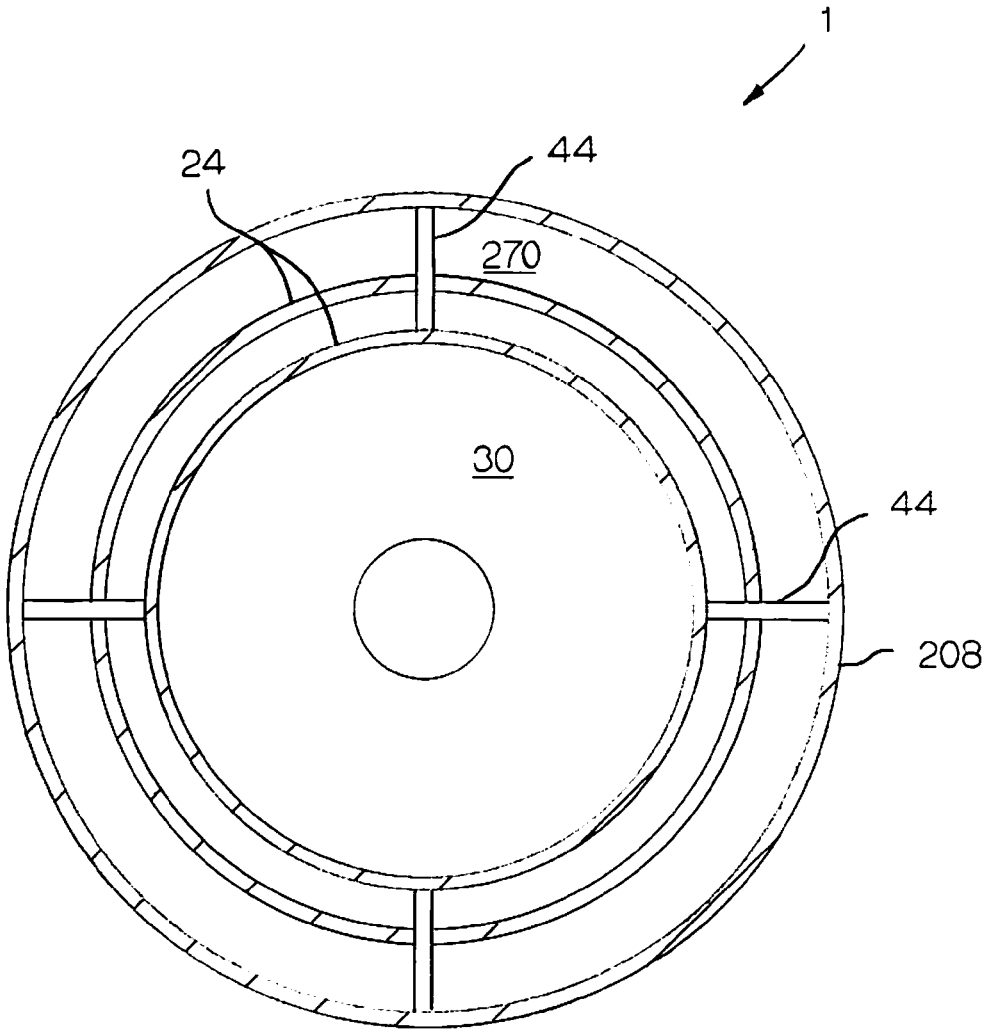
FIG. 4 shows a view taken along the line 4-4 of FIG. 1.
Figure 5:
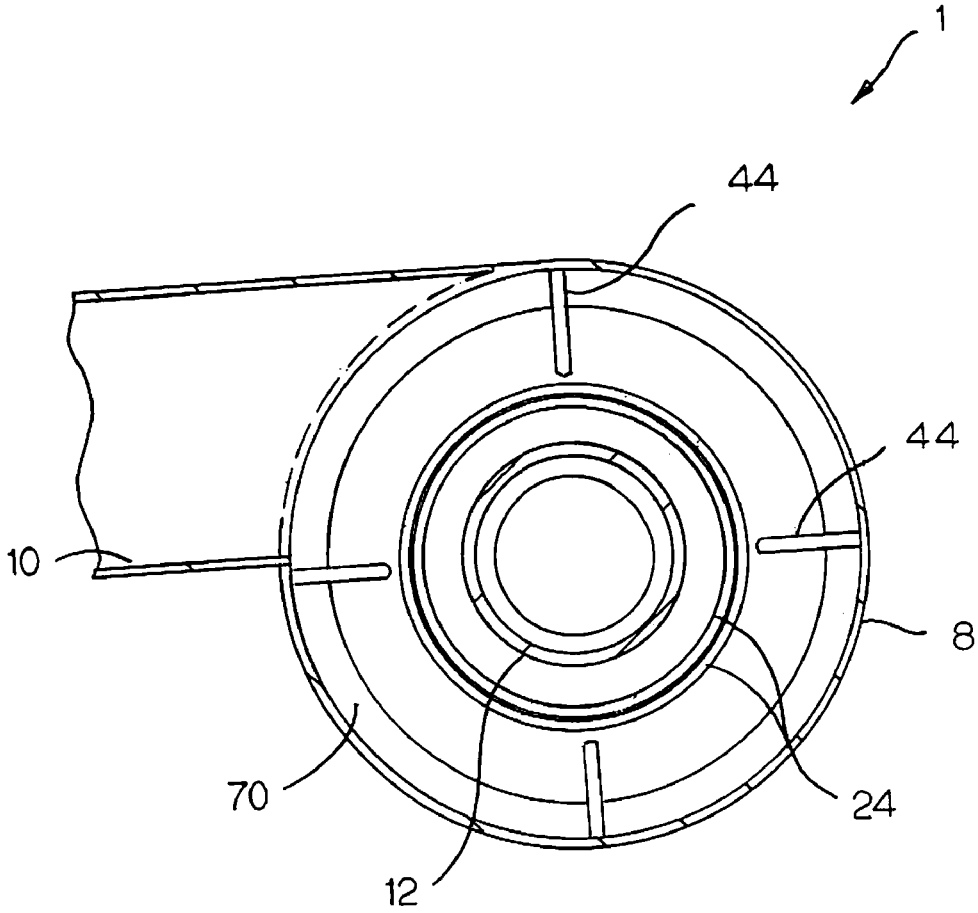
FIG. 5 shows a view taken along the line 5-5 of FIG. 1.

FIGS. 1, 4, and 5 show an example of a cyclone separator 1 with stacked baffles 24 which form a "false" wall to prevent re-entrainment of particles 52 into the swirling gas vortex 46. In this particular embodiment, the baffles 24 have an inverted frustro-conical shape with substantially circular cross sections. Looking at FIG. 1, it can be seen that the cyclone 1 includes a housing 2 which defines an upper end 4, a lower end 6, a sidewall 8, a gas inlet 10, a gas outlet 12, a particulate outlet 14, and a main dip leg 64.

The sidewall 8 has a circular cross-section and defines a central vertical axis 50.

Figure 6:
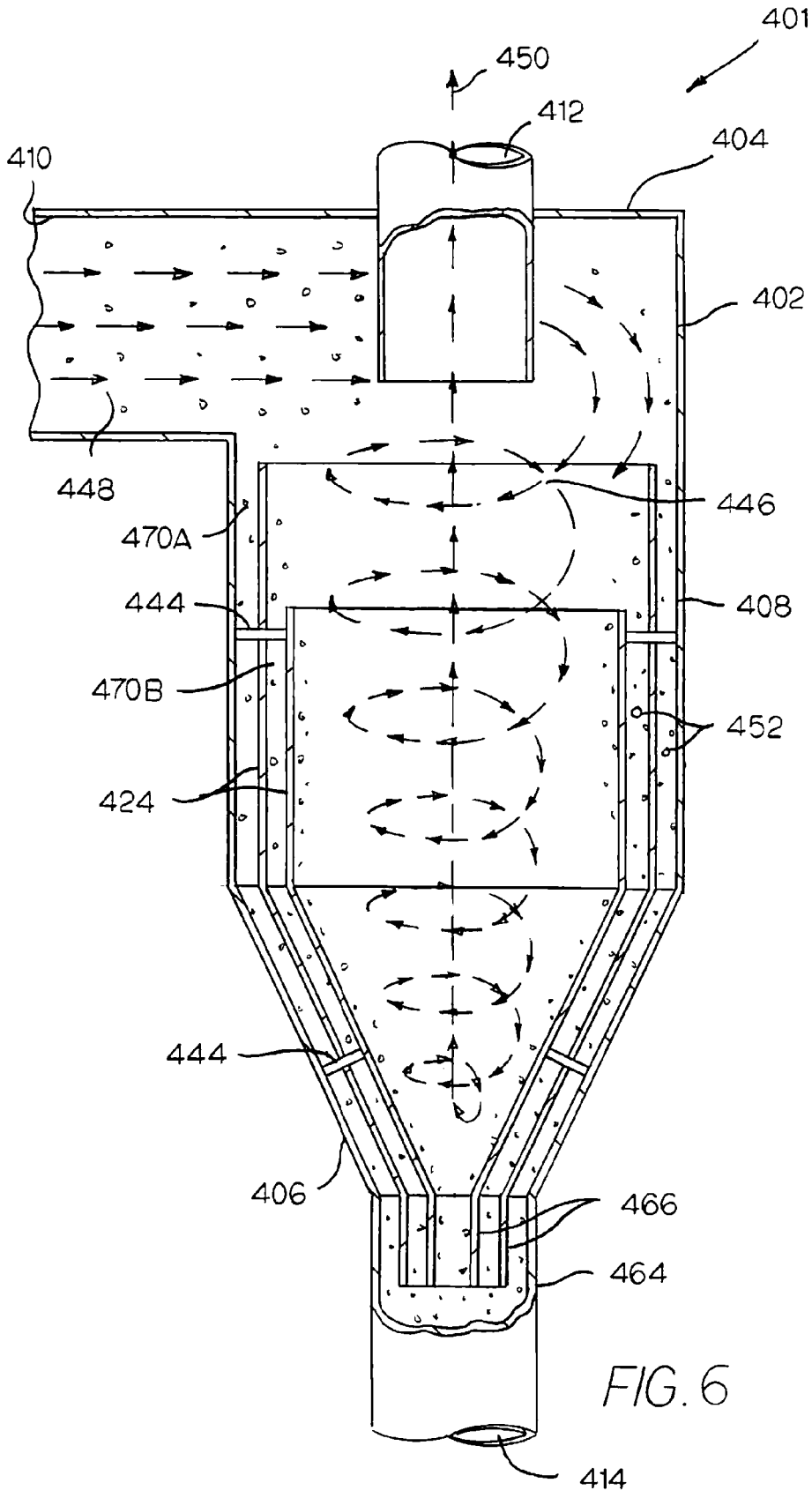
FIG. 6 shows a broken-away front view partially in section of a fourth embodiment of a cyclone separator made in accordance with the present invention.

Within the housing are several stacked baffles 24, including a top baffle 26, an intermediate baffle 27, and a bottom baffle 30. There may be one or several baffles in the cyclone separator 1, preferably between one and ten, depending on the particular application of the separator. The top baffle 26 is located at or below the elevation of the bottom of the gas inlet 10 to prevent erosion of the baffle 26. Each baffle has a top edge 36 and a bottom edge 38, and, if there is a plurality of baffles in the cyclone separator, as in the embodiment in FIG. 1, there is an overlap between the bottom edge 38 of one baffle and the top edge 36 of the next baffle below it, with the top edge of the upper baffle being at a higher elevation than the top edge of an adjacent lower baffle and with the upper baffle extending downwardly outside of, and to a lower elevation than, the top edge of the adjacent lower baffle. It is preferred that there be at least six inches of overlap, but some embodiments may have several feet of overlap as will be seen in more detail later (FIGS. 6 and 7). In the embodiment of FIG. 1, the upper portion of the bottom baffle 30 shares the same inverted frustro-conical shape as the other baffles 24, with the baffles 26, 27, and the top portion of the baffle 30 being concentric and parallel to each other. The lower portion of the bottom baffle 30 has an upright frustro-conical shape, similar to a funnel. This bottom baffle 30 is shaped such that its largest diameter is located at a point 29, between its top edge 36 and its bottom edge 38. It has a shape which tapers both up to its top edge 36 and down to its bottom edge 38. The tapering of the lower portion of the bottom baffle 30 helps to change the direction of the vortex 46, sending the gas up through the axial center 50 of the cyclone 1 and out of the cyclone 1 through the gas outlet 12. The baffles 24 are supported by multiple support rods 44, which are attached to the sidewall 8 of the cyclone 1.

The outer surfaces of the baffles 24 and the inner surface of the sidewall 8 define a space 70 through which the particles 52 fall as they are separated from the vortex 46. There preferably is a distance of at least one inch between the outer surfaces of the baffles 24 and the inner surface of the sidewall 8 to allow particles to fall down through the space 70 to the dip leg 64.

The cyclone separator 1 functions similarly to other cyclone separators, but the baffles 24 form a "false" wall, and confine the vortex to the inside of the baffles 24, while allowing the particles 52 to pass into the space 70 between the baffles 24 and the sidewall 8. When operating, particulate-entrained gas 48 enters tangentially through the gas inlet 10 at the top end 4 of the cyclone separator 1. The gas 48 impacts the side wall 8 and begins to take a swirling, downward path, or vortex 46. As the particulate-entrained gas 48 swirls downwardly along the internal "false wall" formed by the baffles 24, the comparatively heavy particles 52 are flung outwardly beyond the baffles 24. The particles 52 then fall down through the space 70 between the baffles 24 and the sidewall 8, and are protected against re-entrainment by the "false" wall formed by the baffles 24. The particles 52 fall through the space 70 and into the dip leg 64. Meanwhile, as the vortex 46 reaches the bottom of the bottom baffle 30, it changes direction, with the particulate-free gas passing up along the axis 50 and out through the gas outlet 12, while separated particulate 52 falls down and out of the cyclone 1 through the dip leg 64 and outlet 14.

Figure 2:
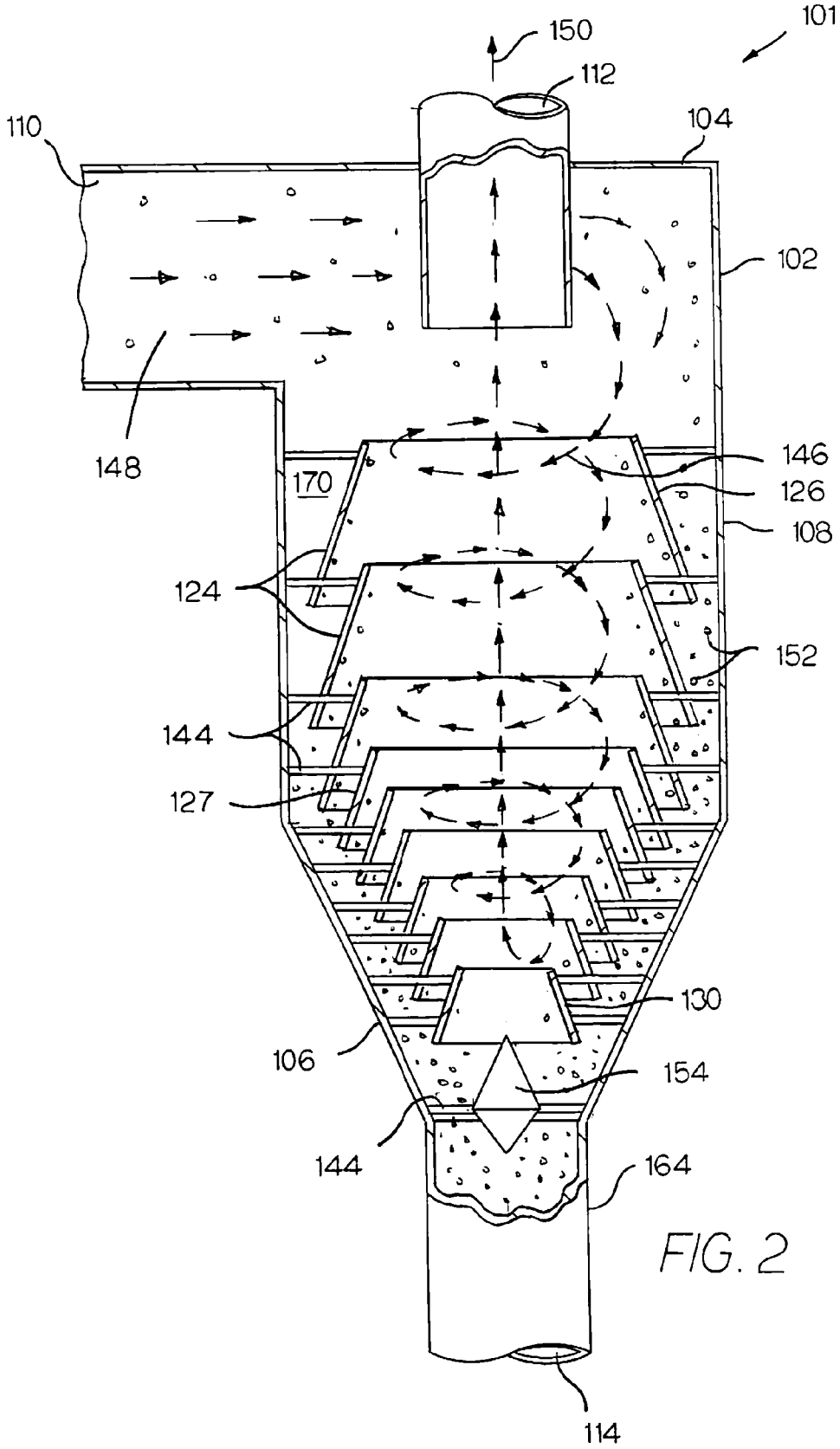
FIG. 2 shows a broken-away front view partially in section of a second embodiment of a cyclone separator made in accordance with the present invention.

FIG. 2 shows another embodiment of a cyclone separator 101 made in accordance with the present invention. Similar to the previous embodiment, the cyclone separator 101 includes a housing 102 which defines an upper end 104, a lower end 106, a sidewall 108, a gas inlet 110, a gas outlet 112, a particulate outlet 114, and a dip leg 164. As in the previous embodiment, there are stacked baffles 124 having an inverted frustro-conical shape which begin at or below the elevation of the bottom of the gas inlet 110. These baffles 124 are supported, as in the previous embodiment, by support rods 144, which extend from the baffles 124 to the sidewall 108. A space 170 is defined between the baffles 124 and the sidewall 108. Unlike the previous embodiment, however, the lowest baffle 130 of this embodiment does not have a lower portion with an upright conical taper. Also, there is a tapered plug 154 below the bottom baffle 130. The plug 154 defines a plug wall that extends across the axis 150 and is spaced inwardly from the sidewall 108. The plug 154 extends both upwardly and downwardly from the entrance to the dipleg 164 and is axially aligned with the cyclone 1. The upper portion of the plug 154 has an inverted conical shape, and the lower portion has an upright conical shape. The plug 154 serves to prevent the vortex 146 from entering the dip leg 164 and re-entraining the particles 152. The plug 154, like the baffles 124, is supported by multiple support rods 144. This embodiment functions essentially the same way as the previous embodiment, with particles being flung into the space 170 and being protected against re-entrainment by the baffles 124 and the plug 154.

Figure 3:
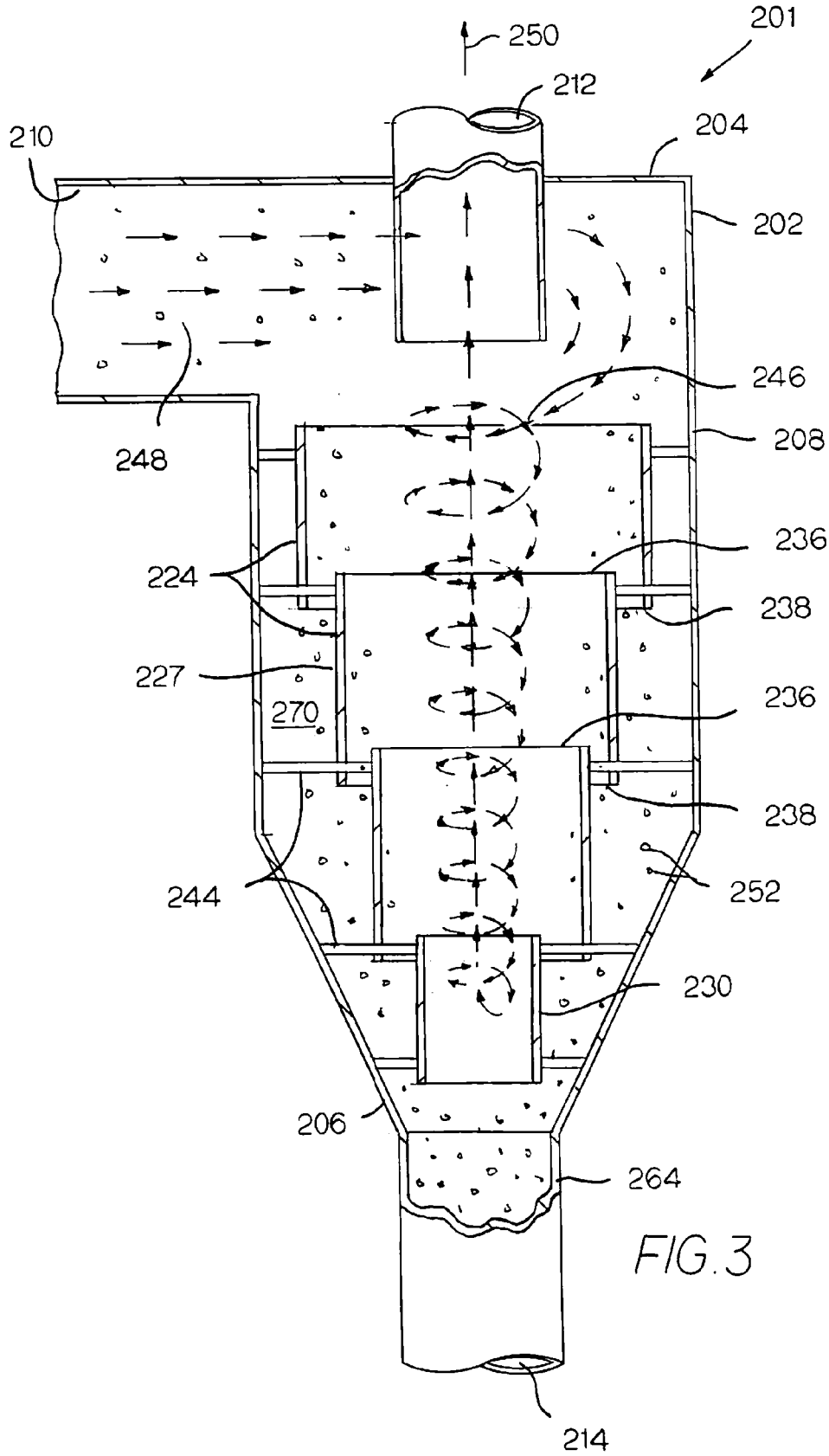
FIG. 3 shows a broken-away front view partially in section of a third embodiment of a cyclone separator made in accordance with the present invention.

FIG. 3 shows another embodiment of a cyclone separator 201 made in accordance with the present invention. As in the previous embodiments, the cyclone 201 includes a housing 202 which defines an upper end 204, a lower end 206, a sidewall 208, a gas inlet 210, a gas outlet 212, a particulate outlet 214, and a dip leg 264. This embodiment also has a plurality of stacked baffles 224, which begin at or below the elevation of the bottom of the gas inlet 210. These baffles 224 are supported, as in the previous embodiment, by support rods 244, which extend from the baffles 224 to the sidewall 208. Again, the baffles 224 and sidewall 208 define the space 270. However, the baffles of this embodiment do not have an inverted frustro-conical shape, but are rather in the shape of cylinders. Just as in the other embodiments, these baffles 224 each have a top edge 236 and a bottom edge 238, and the bottom edge 238 of each baffle 224 overlaps the top edge 236 of the adjacent baffle below it, with the top edge of the upper baffle being at a higher elevation than the top edge of an adjacent lower baffle and with the upper baffle extending downwardly outside of, and to a lower elevation than, the top edge of the adjacent lower baffle.

The bottom baffle 230 of this embodiment is cylindrical, and it terminates above the dip leg 264.

This embodiment functions similarly to the previous embodiments; though the baffles 224 are cylindrically-shaped, they still function to create a space 270 through which the separated particles 252 fall, creating a "false" wall to prevent the re-entrainment of the particles 252.

FIG. 4 is a top section view of the first embodiment (also shown in FIGS. 1 and 5). It clearly shows the supporting rods 44. Whenever there is overlap of the baffles 24 at a supporting rod 44, the rod 44 penetrates the outer baffle 24 and connects to the inner baffle 24, supporting both the inner and outer baffles 24. In this embodiment, the rods are arranged in vertical columns at every 90 degrees of the circle, but they also could be positioned at every 60 degrees, 30 degrees, or some other arrangement, and they could be staggered instead of being aligned with each other. The rods 44 should be of small enough diameter that they do not interfere with the movement of particles 52 and do not cause bridging.

FIG. 5 shows a top sectional view in the upper portion of the first embodiment (also shown in FIGS. 1 and 4). It shows how the particle-entrained gas 48 enters the cyclone 1 tangentially through the gas inlet 10 and begins spiraling downwardly.

FIG. 6 shows another embodiment of a cyclone separator 401 made in accordance with the present invention. As in the previous embodiments, this cyclone 401 includes a housing 402 which defines an upper end 404, a lower end 406, a sidewall 408, a gas inlet 410, a gas outlet 412, a particulate outlet 414, and a dip leg 464. This embodiment, too, has stacked baffles 424 which begin at or below the elevation of the bottom of the gas inlet 410. These baffles 424 are supported by support rods 444 which extend from the baffles 424 to the sidewall 408. The baffles 424 and the sidewall 408 define the space 470.

Each baffle 424 of the embodiment of FIG. 6 has its own individual internal dip leg 466 inside the main dip leg 464. Also, in this embodiment, each baffle has a cylindrical upper portion and an upright conical lower portion leading to the main dip leg 464. In this embodiment, the space 470 between the baffles and the housing is divided into segments, 470A, 470B.

This embodiment functions much the same way as the previous embodiments; the baffles 424 are shaped differently, but they still define a space 470 through which the separated particles 452 fall, and they create a "false" wall to prevent the re-entrainment of the particles 452 into the vortex 446.

It will be obvious to those skilled in the art that modifications may be made to the embodiments described above without departing from the scope of the present invention.

What is claimed is:

1. A cyclone separator, comprising:

a housing having top and bottom ends and a side wall defining a vertical axis and having a substantially circular cross-section;

said housing defining a tangential gas inlet near its top end; a gas outlet at its top end and a particulate outlet at its bottom end; and a plurality of baffles inside said housing, each of said baffles having a substantially circular cross-section and an inner and outer surface and defining a baffle axis aligned with said vertical axis, each of said baffles being spaced inwardly from said side wall, said baffles being at different elevations with each baffle having a top edge and a bottom edge, with the top edge of an upper baffle being at a higher elevation than the top edge of an adjacent lower baffle and with the upper baffle extending downwardly outside of, and to a lower elevation than, the top edge of the adjacent lower baffle, so that particulate-entrained gas enters the tangential gas inlet and flows in a spiral path inside the baffles, with separated particles falling downwardly between the baffles and the side wall to the particulate outlet and with the gas reversing direction near the bottom of the housing and flowing upwardly inside the spiral to the gas outlet.

2. A cyclone separator as recited in claim 1, and further comprising:

a plug located near the bottom end of said housing above said particulate outlet, including a plug wall that extends across said axis and is spaced inwardly from said side wall to define a path for particulate to pass from inside said housing through said particulate outlet.

3. A cyclone separator as recited in claim 1, wherein at least one of the baffles has an inverted frustro-conical shape.

4. A cyclone separator as recited in claim 3, wherein at least the bottom baffle has an inverted frustro-conical upper portion and an upright frustro-conical lower portion, and wherein said at least bottom baffle defines a largest baffle diameter at a point intermediate its top edge and its bottom edge.

5. A cyclone separator as recited in claim 1, wherein at least one of the baffles has a cylindrical shape.

6. A cyclone separator as recited in claim 5, wherein all the baffles have a cylindrically-shaped upper portion and an upright frustro-conical lower portion.

7. A cyclone separator as recited in claim 1, wherein said housing defines a dip leg leading toward said particulate outlet and wherein at least one of said baffles extends into the dip leg.

* * * * *